US010461428B2

(12) United States Patent
Jeong et al.

(10) Patent No.: US 10,461,428 B2
(45) Date of Patent: Oct. 29, 2019

(54) MULTI-LAYER ANTENNA

(71) Applicant: QUALCOMM Incorporated, San Diego, CA (US)

(72) Inventors: Seong Heon Jeong, San Diego, CA (US); Mohammad Ali Tassoudji, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/903,065

(22) Filed: Feb. 23, 2018

(65) Prior Publication Data

US 2019/0267713 A1 Aug. 29, 2019

(51) Int. Cl.

| | |
|---|---|
| ***H01Q 9/04*** | (2006.01) |
| ***H01Q 9/06*** | (2006.01) |
| ***H01Q 5/385*** | (2015.01) |
| ***H01Q 19/00*** | (2006.01) |
| ***H01Q 1/24*** | (2006.01) |

(52) U.S. Cl.

CPC ..... *H01Q 9/0414* (2013.01); *H01Q 5/385* (2015.01); *H01Q 9/065* (2013.01); *H01Q 19/005* (2013.01); *H01Q 1/243* (2013.01); *H01Q 9/0428* (2013.01)

(58) Field of Classification Search

CPC ..... H01Q 5/378; H01Q 5/385; H01Q 19/005; H01Q 9/0414

See application file for complete search history.

(56) References Cited

U.S. PATENT DOCUMENTS

| | | | | |
|---|---|---|---|---|
| 5,497,164 | A * | 3/1996 | Croq | H01Q 9/0414 343/700 MS |
| 7,038,624 | B2 * | 5/2006 | Yegin | H01Q 9/0407 343/700 MS |
| 7,068,234 | B2 * | 6/2006 | Sievenpiper | H01Q 3/26 343/745 |
| 9,583,839 | B2 | 2/2017 | Liu et al. | |

(Continued)

FOREIGN PATENT DOCUMENTS

| | | | |
|---|---|---|---|
| EP | 0911906 | B1 | 3/2006 |
| EP | 2201642 | A1 | 6/2010 |
| WO | 2017180956 | A1 | 10/2017 |

OTHER PUBLICATIONS

Dominguez G.E., et al., "New EBG Solutions for Mutual Coupling Reduction",2012 6th European Conference on Antennas and Propagation (EUCAP), Mar. 1, 2012 (Mar. 1, 2012), pp. 2841-2844, XP055584564, DOI: 10.1109/EuCAP.2012.6206261ISBN: 978-1-4577-0919-7, Section V, Figure 12.

(Continued)

*Primary Examiner* — Daniel Munoz

(74) *Attorney, Agent, or Firm* — Hunter Clark PLLC

(57) ABSTRACT

A multi-layer laminate antenna includes: a feed line configured to convey electricity; a radiator coupled to the feed line, comprising metal disposed in a first layer of the antenna, and having an edge of a length to radiate energy at a radiating frequency; and dummy metal disposed in a second layer of the antenna that is different from the first layer of the antenna; where a first portion of the dummy metal is configured such that any linear edge of the first portion of the dummy metal disposed outside an area of the second layer overlapped by the radiator is less than half of a radiating wavelength corresponding to the radiating frequency.

29 Claims, 11 Drawing Sheets

(56) References Cited

U.S. PATENT DOCUMENTS

| | | | | |
|---|---|---|---|---|
| 9,659,899 | B2 | 5/2017 | Sane et al. | |
| 2005/0179610 | A1* | 8/2005 | Le | H01Q 1/246 343/797 |
| 2007/0052587 | A1 | 3/2007 | Cheng | |
| 2010/0090903 | A1* | 4/2010 | Byun | H01Q 9/0407 343/700 MS |
| 2010/0156732 | A1* | 6/2010 | Ito | H01Q 1/52 343/787 |
| 2016/0294052 | A1* | 10/2016 | Baek | H01Q 3/01 |

OTHER PUBLICATIONS

International Search Report and Written Opinion—PCT/US2019/019125—ISA/EPO—dated May 9, 2019.

Kush A., et al., "Triple-Band Compact Circularly Polarised Stacked Microstrip Antenna Over Reactive Impedance Meta-Surface for GPS Applications", IET Microwaves, Antennas & Propaga, The Institution of Engineering and Technology, United Kingdom, vol. 8, No. 13, Oct. 21, 2014 (Oct. 21, 2014), pp. 1057-1065, XP006049754, ISSN: 1751-8725, DOI: 10.1049/IET-MAP.2013.0586, Sections 1, 2, 2.1, Figures Ia, 1b, 2, 3b.

Li X.S., et al., "Metamaterial Extends Patch Antenna Bandwidth", May 6, 2015 (May 6, 2015), pp. 1-9, XP055304210, Retrieved from the Internet:URL:http://mwrf.com/print/passive-components/metamaterial-extends-patch-antenna-bandwidth [retrieved on Sep. 20, 2016], First Page, Right Column, Figures 1, 5.

Qu D., et al., "Improving Microstrip Patch Antenna Performance Using EBG Substrates",IEE Proceedings: Microwaves, Antennas and Propagat, IEE Stevenage, Hertz, GB, vol. 153, No. 6, Dec. 4, 2006 (Dec. 4, 2006), pp. 558-563, XP006027758, ISSN: 1350-2417, DOI: 10.1049/1P-MAP:20060015, Figure 5.

* cited by examiner

MULTI-LAYER ANTENNA

BACKGROUND

Wireless communication devices are increasingly popular and increasingly complex. For example, mobile telecommunication devices have progressed from simple phones, to smart phones with multiple communication capabilities (e.g., multiple cellular communication protocols, Wi-Fi, BLUETOOTH® and other short-range communication protocols), supercomputing processors, cameras, etc. Wireless communication devices have antennas to support wireless communication over a range of frequencies.

It is often desirable to have a thin antenna system. For example, mobile communication devices typically have multiple antenna systems that are each required to be thin to fit within a thin form factor of the mobile communication device (e.g., a smartphone, tablet computer, etc.). Multi-layer antennas systems, with one or more layers of radiating metal, may be used to provide thin antenna systems. In certain implementations a layer without significant metallization or stiffening elements in at least a portion of the layer may deform to an unacceptable extent.

SUMMARY

An example of a multi-layer laminate antenna includes: a feed line configured to convey electricity; a radiator coupled to the feed line, comprising metal disposed in a first layer of the antenna, and having an edge of a length to radiate energy at a radiating frequency; and dummy metal disposed in a second layer of the antenna that is different from the first layer of the antenna; where a first portion of the dummy metal is configured such that any linear edge of the first portion of the dummy metal disposed outside an area of the second layer overlapped by the radiator is less than half of a radiating wavelength corresponding to the radiating frequency.

Implementations of such an antenna may include one or more of the following features. The first portion of the dummy metal comprises similarly-shaped pieces each with a longest linear edge dimension being shorter than one-tenth of the radiating wavelength. The similarly-shaped pieces are rectangular. The similarly-shaped pieces are electrically separated from each other. The first portion of the dummy metal comprises multiple pieces, where at least one of the pieces is circularly shaped, or at least one of the pieces is triangularly shaped, or at least one of the pieces is irregularly shaped. The radiator includes at least one patch radiator, or at least one dipole radiator, or a combination of at least one patch radiator and at least one dipole radiator.

Also or alternatively, implementations of such an antenna may include one or more of the following features. The radiator is a rectangular patch radiator, a virtual centerline extends through a center of the patch radiator perpendicularly to the first layer and the second layer, the first portion of the dummy metal comprises all of the dummy metal disposed in the second layer more than one-eighth of the radiating wavelength, corresponding to the radiating frequency, away from the centerline orthogonally toward any edge of the rectangular patch radiator projected into the second layer, and the first portion of the dummy metal is configured such that any linear edge of the first portion of the dummy metal is less than half of the radiating wavelength. The rectangular patch radiator is square, and a second portion of the dummy metal, separate from the first portion of the dummy metal and in the second layer, includes a contiguous sheet of metal, overlaps the patch radiator, is co-centered with the patch radiator, and has a longest straight edge length no more than one-third of the radiating wavelength corresponding to the radiating frequency. At least some of the first portion of the dummy metal overlaps with the rectangular patch radiator.

Also or alternatively, implementations of such an antenna may include one or more of the following features. The dummy metal is absent from a region of the second layer that overlaps a perimeter of the radiator. The dummy metal is first dummy metal, the antenna further including second dummy metal disposed in a third layer of the antenna that is separate from the first layer and the second layer, the second dummy metal being absent from a region of the third layer that overlaps the perimeter of the radiator. A second portion of the dummy metal overlaps the patch radiator and at least some of the first portion of the dummy metal is disposed outwardly of the perimeter of the patch radiator projected, orthogonally to the first layer and the second layer, onto the second layer. The first portion of the dummy metal, the second portion of the dummy metal, and the patch radiator are co-centered such that the second layer comprises the second portion of the dummy metal surrounded by a ring of the second layer that is devoid of metal and at least some of the first portion of the dummy metal disposed outwardly of the ring.

Also or alternatively, implementations of such an antenna may include one or more of the following features. The antenna further includes a parasitic element disposed in a fourth layer of the antenna, the parasitic element comprising a sheet of metal overlying the patch radiator and being electrically isolated from the feed line, the second layer of the antenna being disposed between the first layer of the antenna and the fourth layer of the antenna and adjacent to the fourth layer of the antenna. An area of the parasitic element is different in size than an area of the patch radiator. The parasitic element is one of multiple parasitic elements each disposed in a respective layer of the antenna, each of the parasitic elements being larger in size than a nearest one of the parasitic elements that is closer to the patch radiator. The dummy metal is disposed over an area that is at least 40% of an area of the second layer. The dummy metal is first dummy metal, and the antenna further includes second dummy metal disposed in the first layer of the antenna.

Another example of a multi-layer laminate antenna includes: means for energizing; radiating means, coupled to the means for energizing, for radiating energy received from the means for energizing, the radiating means being disposed in a first layer of the antenna and comprising a contiguous piece of metal configured to radiate at a radiating frequency; and first means for stiffening disposed in a second layer of the antenna that is different from the first layer of the antenna, the first means for stiffening comprising metal with any linear edge of the first means for stiffening disposed outside an area of the second layer overlapped by the contiguous piece of metal being less than half of a radiating wavelength corresponding to the radiating frequency.

Implementations of such an antenna may include one or more of the following features. The first means for stiffening comprise rectangular metal pieces each with a longer linear edge length no more than one-fifth of the radiating wavelength and each of the rectangular metal pieces with a shorter linear edge length at least one-tenth of the radiating wavelength. The contiguous piece of metal is a rectangular patch radiator, a virtual centerline extends through a center of the radiating means perpendicularly to the first layer and the second layer, and the rectangular metal pieces comprise all of the first means for stiffening disposed in the second layer more than one-fourth of the length of each edge of the radiating means away from the centerline orthogonally toward any edge of the contiguous piece of metal projected into the second layer. Some of the rectangular metal pieces overlap with the contiguous piece of metal.

Also or alternatively, implementations of such an antenna may include one or more of the following features. The first means for stiffening are absent from a region of the second layer that overlaps a perimeter of the contiguous piece of metal. The antenna further includes second means for stiffening disposed in a third layer of the antenna that is separate from the first layer and the second layer, the second means for stiffening being absent from a region of the third layer that overlaps the perimeter of the contiguous piece of metal. A first portion of the first means for stiffening overlaps the contiguous piece of metal and a second portion of the first means for stiffening is disposed outwardly of the perimeter of the contiguous piece of metal projected, orthogonally to the first layer and the second layer, onto the second layer. The first means for stiffening is further for increasing a bandwidth of the radiating means while maintaining a gain of the radiating means.

An example of a mobile device includes: a display; a processor communicatively coupled to the display; a transceiver communicatively coupled to the processor; and an antenna communicatively coupled to the transceiver and including: a feed line configured to convey electricity; a radiator coupled to the feed line and comprising a solid metal piece disposed in a first layer of the antenna and having an edge length configured to radiate energy at a radiating frequency; and dummy metal disposed in a second layer of the antenna that is different from the first layer of the antenna, the dummy metal comprising rectangular pieces of metal each with a longer linear edge length less than one-tenth of a radiating wavelength corresponding to the radiating frequency, the dummy metal being absent from a region of the second layer overlapping a perimeter of the radiator.

Implementations of such a mobile device may include one or more of the following features. The antenna further includes: a ground plane; a parasitic element disposed in a third layer of the antenna, with the first layer overlying the ground plane, the second layer overlying the first layer, and the third layer overlying the second layer. The parasitic element is a first dummy parasitic element, the dummy metal is first dummy metal, and the antenna further includes: second dummy metal disposed in a fourth layer of the antenna that is different from the first, second, and third layers of the antenna, the second dummy metal comprising a plurality of rectangular pieces of metal each with a longer linear edge length less than one-tenth of the radiating wavelength, the second dummy metal being absent from a region of the fourth layer overlapping a perimeter of the radiator; and a second dummy parasitic element disposed in a fifth layer of the antenna; where the fourth layer overlies the third layer and the fifth layer overlies the fourth layer. The dummy metal is disposed over an area that is at least 40% of an area of the second layer.

DETAILED DESCRIPTION

Techniques are discussed herein for arranging non-radiating metal in a multi-layer antenna. For example a multi-layer laminate antenna configuration is provided with each layer containing metal. Metal is provided in each layer in a sufficient amount and placement to prevent the layer from deforming unacceptably. For example, each layer may have 50% or more of the layer be metal, with any "dummy" metal being distributed across the layer while not overlapping with a radiating edge of a radiating element (on another layer). Radiating metal may be one or more patch radiators, one or more dipole radiators, or a combination thereof. Each piece of the dummy metal that is disposed outwardly (when viewed looking down through the layers of the antenna configuration) of a radiating element may have a longest linear edge dimension that is no longer than one-tenth of a radiating wavelength of a radiating element. Dummy metal disposed inwardly of a radiating element (e.g., inside an area of a patch antenna) may be contiguous, with a longest dimension over a tenth of the radiating wavelength. Metal (radiating-element metal, dummy metal, or a combination thereof) may be disposed about a periphery of each layer. Other configurations, however, may be used.

Items and/or techniques described herein may provide one or more of the following capabilities, as well as other capabilities not mentioned. A multi-layer antenna may be provided with sufficient stiffness in each layer. A bandwidth of a patch radiator in a multi-layer antenna may be increased by adding stiffening metal to layers of the antenna, e.g., layers not including the patch radiator and/or a layer including the patch radiator. Stiffening metal may be provided in layers of a multi-layer antenna including a patch radiator without decreasing gain, or at least not significantly decreasing gain, of the patch radiator. Mechanical robustness of a multi-layer stack-up can be enhanced significantly and may prevent deformation during or after fabrication. Furthermore, each thickness of a layer can be maintained within a tolerance. Other capabilities may be provided and not every implementation according to the disclosure must provide any, let alone all, of the capabilities discussed. Further, it may be possible for an effect noted above to be achieved by means other than that noted, and a noted item/technique may not necessarily yield the noted effect.

Figure 1:
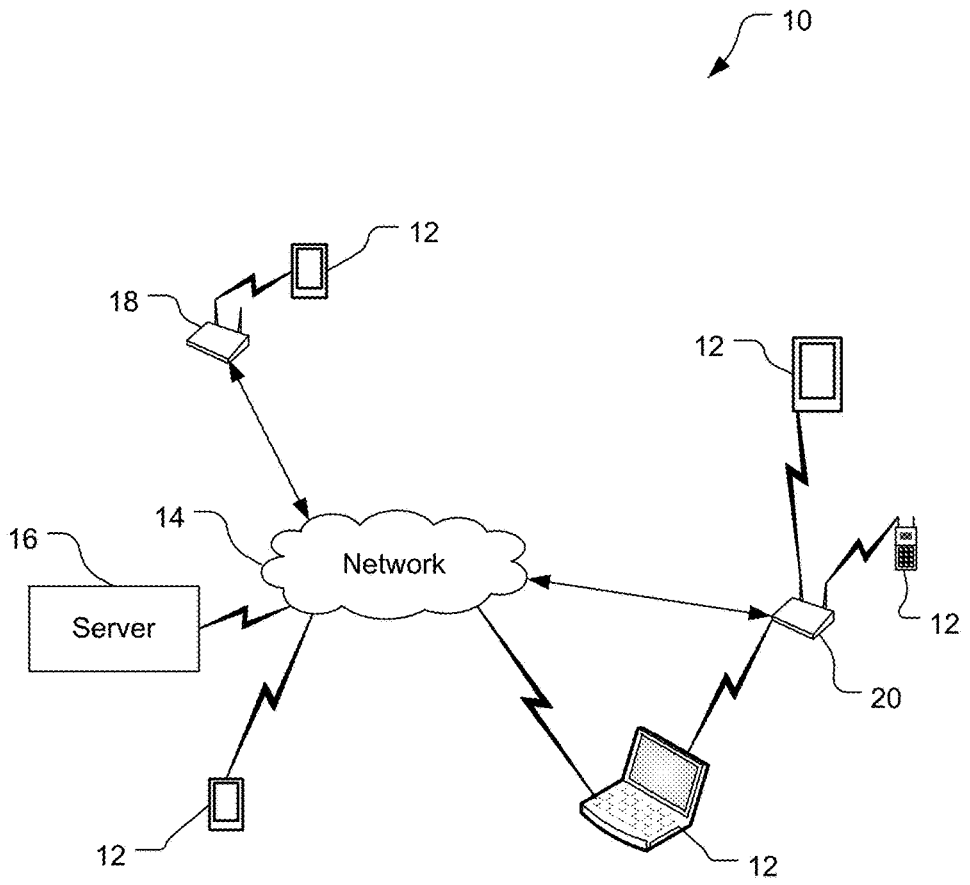
FIG. 1 is a schematic diagram of a communication system.

Referring to FIG. 1, a communication system 10 includes mobile devices 12, a network 14, a server 16, and access points (APs) 18, 20. The system 10 is a wireless communication system in that components of the system 10 can communicate with one another (at least some times using wireless connections) directly or indirectly, e.g., via the network 14 and/or one or more of the access points 18, 20 (and/or one or more other devices not shown, such as one or more base transceiver stations). For indirect communications, the communications may be altered during transmission from one entity to another, e.g., to alter header information of data packets, to change format, etc. The mobile devices 12 shown are mobile wireless communication devices (although they may communicate wirelessly and via wired connections) including mobile phones (including smartphones), a laptop computer, and a tablet computer. Still other mobile devices may be used, whether currently existing or developed in the future. Further, other wireless devices (whether mobile or not) may be implemented within the system 10 and may communicate with each other and/or with the mobile devices 12, network 14, server 16, and/or APs 18, 20. For example, such other devices may include internet of thing (IoT) devices, medical devices, home entertainment and/or automation devices, etc. The mobile devices 12 or other devices may be configured to communicate in different networks and/or for different purposes (e.g., 5G, Wi-Fi communication, multiple frequencies of Wi-Fi communication, satellite positioning, one or more types of cellular communications (e.g., GSM (Global System for Mobiles), CDMA (Code Division Multiple Access), LTE (Long-Term Evolution), etc.).

Figure 2:
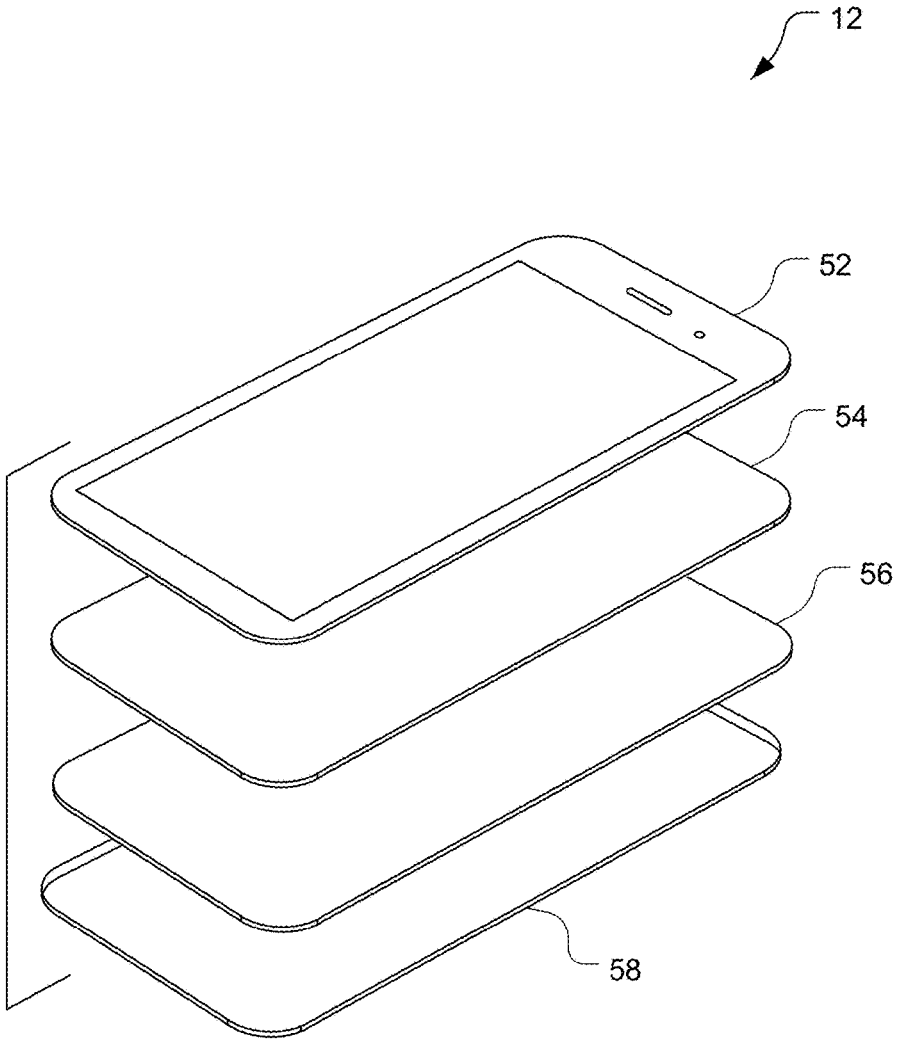
FIG. 2 is an exploded perspective view of simplified components of a mobile device shown in FIG. 1.

Referring to FIG. 2, an example of one of the mobile devices 12 shown in FIG. 1 includes a top cover 52, a display 54, a printed circuit board (PCB) 56, and a bottom cover 58. The mobile device 12 as shown may be a smartphone or a tablet computer but the discussion is not limited to such devices. The PCB 56 includes one or more antennas configured to facilitate bi-directional communication between mobile device 12 and one or more other devices, including other wireless communication devices. Further, the size and/or shape of the PCB 56 may not be commensurate with the size and/or shape of either of the top or bottom covers or otherwise with a perimeter of the device. For example, the PCB 56 may have a cutout to accept a battery. Those of skill in the art will therefore understand that embodiments of the PCB 56 other than those illustrated may be implemented.

Figure 3:
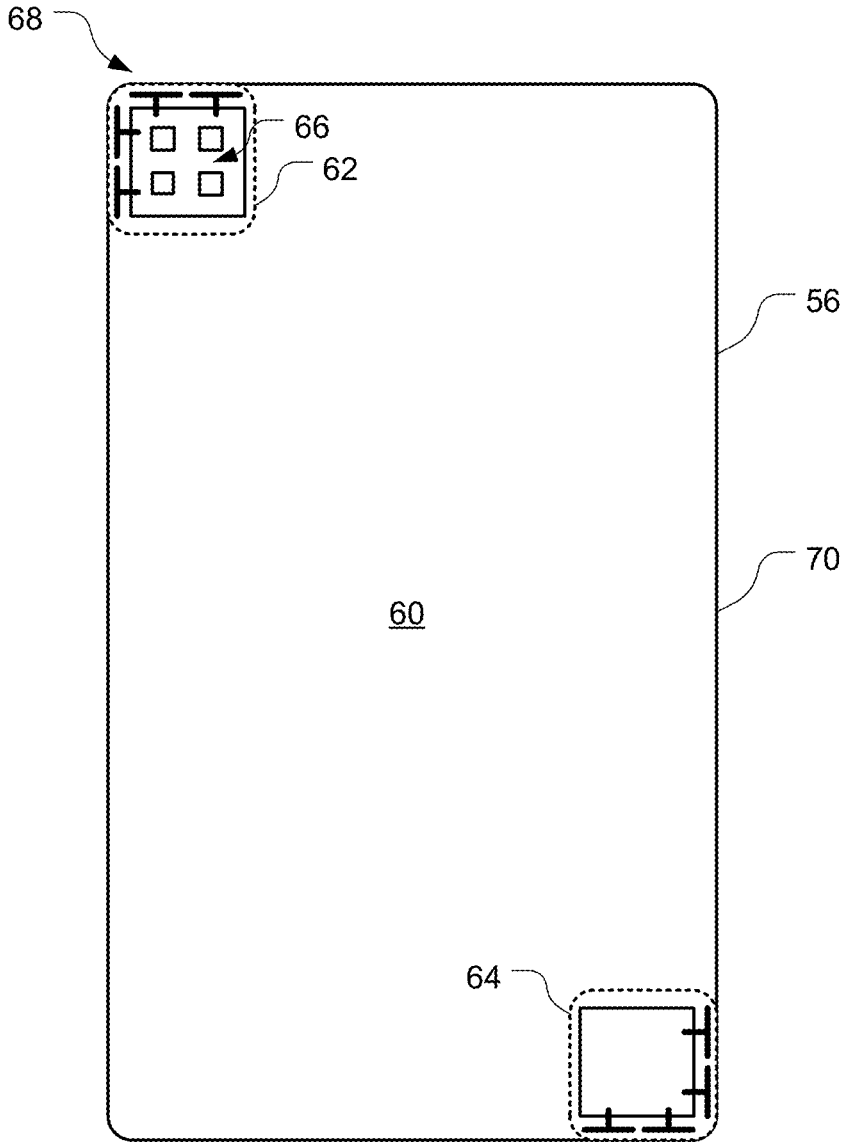
FIG. 3 is a top view of a printed circuit board, shown in FIG. 2, including antennas.

Referring also to FIG. 3, an example of the PCB 56 includes a main portion 60 and two antennas 62, 64. The antennas 62, 64 are configured similarly, with multiple radiators to facilitate communication with other devices at various directions relative to the mobile device 12. In the example of FIG. 3, the antenna 62 includes patch radiators 66 and dipole radiators 68, as further shown, for example, in FIG. 4. In other examples, one or more antennas may include one or more dipole radiators only, one or more patch radiators only, or a combination of one or more diploe radiators and one or more patch radiators. In other examples, one or more other types of radiators may be used alone or in combination with one or more dipole radiators and/or one or more patch radiators. The patch radiators are configured to radiate signals primarily to, and receive signals primarily from, above and below a plane of the PCB 56, i.e., into and out of the page showing FIG. 3. The dipole radiators are configured to radiate signals primarily to, and receive signals primarily from, sides of PCB 56, with the dipole radiators 68 in the antenna 62 configured to radiate primarily to the top and left of the PCB 56 as shown in FIG. 3 and the dipole radiators in the antenna 64 configured to radiate primarily to the right and bottom of the PCB 56 as shown in FIG. 3. Positioning the antennas 62, 64 in or near corners of the PCB 56 may help provide spatial diversity (directions relative to the mobile device 12 to which signals may be transmitted and from which signals may be received), e.g., to help increase MIMO (Multiple Input, Multiple Output) capability. Further, the patch radiators 66 may be configured to provide dual polarization radiation and reception.

The PCB 56, including the antennas 62, 64, comprises a multi-layer substrate 70. The antennas 62, 64 may comprise eight layers, 14 layers, or another quantity of layers. For example, the antennas 62, 64 may comprise a 14-layer FCBGA (Flip Chip Ball Grid Array) and may be mounted on the PCB 60. In some embodiments, one or more of the antennas 62, 64 are integrated with a transceiver chipset on the same substrate. Each layer of the antennas 62, 64 may include some amount of metal to provide sufficient mechanical strength and manufacturability. It has been found that adding metal to layers of the antennas 62, 64 may negatively affect performance of the patch radiators 66, e.g., due to parasitic coupling. It has been further found that by appropriate design of dummy metal in the layers of the antennas 62, 64, performance of the patch radiators 66 may be improved, while also providing desired mechanical strength and manufacturability of the antennas 62, 64. Thus, contrary to prior designs in which the addition of metal layers to an antenna degraded performance, inclusion of dummy metal as described in certain embodiments herein may in fact benefit performance, for example by enabling the antenna to transmit and/or receive across a wider bandwidth. The dummy metal may comprise metal pieces that are each not electrically connected (not connected by an electrical conductor) to the patch radiators 66, or other radiating elements. The dummy metal may be metal pieces that are not connected to receive power, e.g., not connected by a conductor to a power source that provides power to the patch radiators 66. The dummy metal may comprise metal pieces that are not electrically connected to items in other layers of the PCB 56. The dummy metal may be configured (sized and shaped) to be non-radiating, or to radiate insignificant amounts of energy (e.g., less than 5% as much as radiated by the patch radiators 66), at a radiating frequency (or frequencies) of the patch radiators 66. Each dummy metal piece may be shaped such that no linear (straight) edge of the dummy metal piece exceeds half of a radiating wavelength. For example, a longest linear edge (if any) of a dummy metal piece may be less than 40% of the radiating wavelength, or less than 25% of the radiating wavelength, or less than 20% of the radiating wavelength, or less than 10% of the radiating wavelength. In some embodiments, the metal pieces of the dummy metal are large enough that a current is induced therein, but not so large as to radiate at or near a radiating frequency (or frequencies) of the patch radiators 66.

Figure 4:
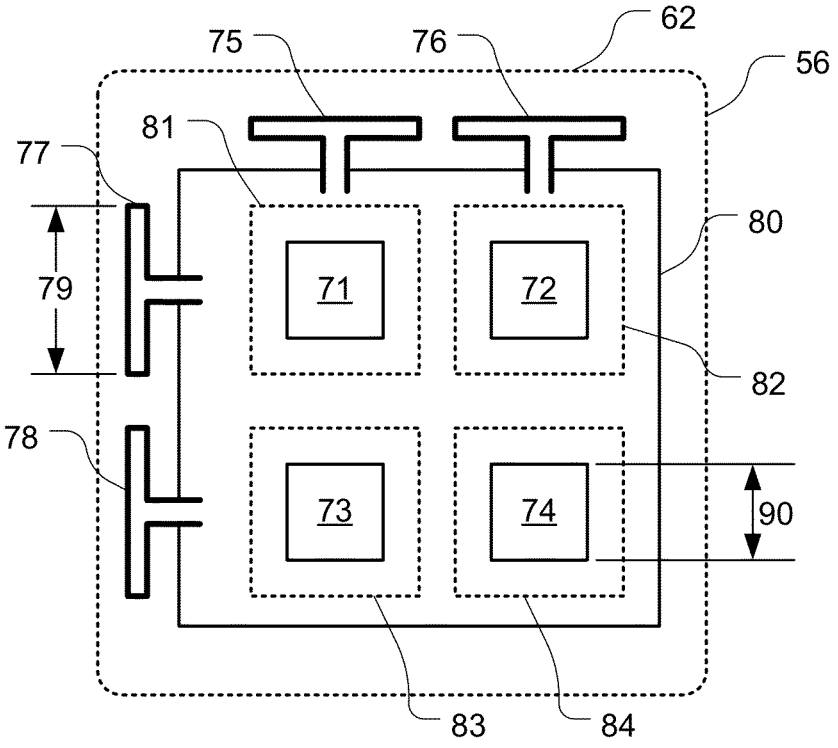
FIG. 4 is a top view of patch radiators and dipole radiators of one of the antennas shown in FIG. 3.

Referring also to FIG. 4, the antenna 62 includes patch radiators 71, 72, 73, 74, dipole radiators 75, 76, 77, 78, and a ground plane 80. The patch radiators 71-74 and the dipole radiators 75-78 may comprise flat metal pieces each disposed in a layer of the antenna 62. The patch radiators 71-74 may all be disposed in the same layer of the antenna 62. The dipole radiators 75-78 may all be disposed in the same layer, and may or may not be disposed in the same layer as the patch radiators 71-74. For example, the patch radiators 71-74 may be disposed in the $8^{th}$ layer of a 14-layer substrate and the dipole radiators 75-78 may be disposed in the $5^{th}$ layer of the 14-layer substrate, although other layer locations of the radiators 71-78 may be used. The ground plane 80 underlies the patch radiators 71-74. In FIG. 4, the patch radiators 71, 72, 73, 74, the dipole radiators 75, 76, 77, 78, and the ground plane 80 are all shown in solid lines, but are disposed in different layers of the PCB 56. Broken lines in FIG. 4 represent the antenna 62 and patch radiator regions 81, 82, 83, 84 of the antenna 62, with the antenna 62 and the patch radiator regions 81-84 extending through all the layers of the substrate 70. Each of the patch radiator regions 81-84 may be configured similarly. Two or more of the patch radiator regions 81-84 may be configured differently from each other, e.g., in the same layer or in different layers of the antenna 62. For example, dummy metal configurations, discussed more fully below, may be different between different ones of the patch radiator regions 81-84.

The antenna 62 is configured to radiate energy at one or more radiating frequencies. Each of the patch radiators 71-74 is configured to radiate energy at a patch radiating frequency. Here, each of the patch radiators 71-74 is a rectangle, in this example a square, with each side having a length 90. The length 90 determines a wavelength at which each of the patches 71-74 will radiate energy, with the length 90 measuring substantially half of a radiating wavelength, e.g., between 40% of the radiating wavelength and half of the radiating wavelength. The radiating wavelength is the wavelength in the antenna 62, e.g., in a dielectric of the substrate 70 of the antenna 62 corresponding to the patch radiating frequency. Alternatively, the patch radiators 71-74 may be rectangles with different lengths of sides and thus have two different patch radiating frequencies. Each of the dipole radiators 75-78 has a width 79 of substantially half of a dipole radiating wavelength. A dipole radiating wavelength and the corresponding dipole radiating frequency may be the same as or different from a patch radiating wavelength and the corresponding patch radiating frequency. Further, different dipoles may have different dipole radiating wavelengths (and frequencies) and/or different patches may have different patch radiating wavelengths (and frequencies) and/or different antennas may have different radiating wavelengths (and frequencies).

Sizes of dummy metal pieces provided in the antenna 62 (and elsewhere) are discussed herein in terms of portions of radiating wavelength. This radiating wavelength may be any radiating wavelength of the antenna 62. For example, the radiating wavelength may be the only radiating wavelength of the antenna 62, or may be the shorter radiating wavelength if there are two radiating wavelengths, or may be the shortest radiating wavelength if there are more than two radiating wavelengths.

Figure 5:
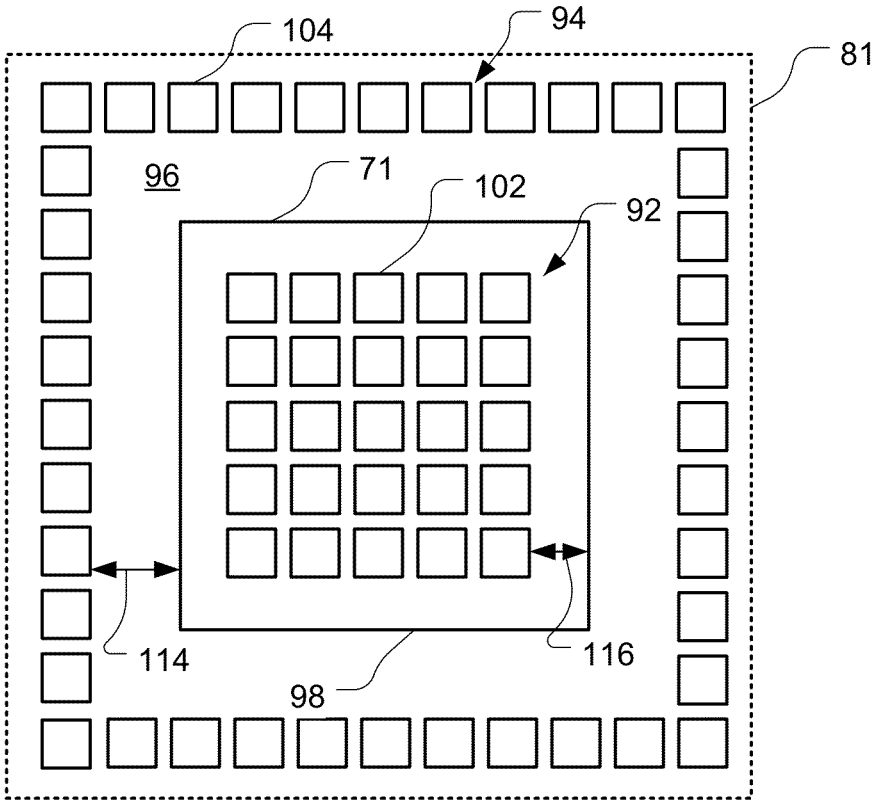
FIG. 5 is a top view of a patch radiator portion of the antenna shown in FIG. 4.

Referring to FIG. 5, with further reference to FIG. 4, an example of the patch radiator region 81 includes the patch radiator 71, interior dummy metal 92, and exterior dummy metal 94. The patch radiator 71 and the dummy metal 94 may or may not be on separate layers of the antenna 62 but are all shown in solid lines. Further, the patch radiator 71 and the dummy metal 92 are on separate layers of the PCB 56 but are all shown in solid lines. The interior dummy metal 92 comprises multiple interior dummy metal pieces 102 and the exterior dummy metal 94 comprises multiple exterior dummy metal pieces 104. The interior dummy metal 92 is separated from the exterior dummy metal 94 by a keep-out zone 96 that overlaps a perimeter 98 of the patch radiator 71. The dummy metal pieces 102 are electrically separated from (i.e., not electrically connected to) each other and from the dummy metal pieces 104. The dummy metal pieces 104 are electrically separated from (i.e., not electrically connected to) each other and from the dummy metal pieces 102. Further, the interior dummy metal 92 and/or the exterior dummy metal 94 may be provided in more than one layer of the antenna 62. The interior dummy metal 92 may have different configurations in different layers and the exterior dummy metal 94 may have different configurations in different layers. It has been found that providing the dummy metal 92, 94 of appropriate size, relative spacing, amount, and location can improve mechanical stability and manufacturability of the antennas 62, 64 and also increase bandwidth of the patch radiator 71 while maintaining gain (i.e., without decreasing gain) of the patch radiator 71, although these capabilities are not provided by all configurations of dummy metal, and are not required by the claims unless explicitly stated.

As shown, the interior dummy metal pieces 102 are spaced uniformly from each other and disposed uniformly (i.e., evenly, with similar-sized gaps between the pieces 102) within a region occupied by the interior dummy metal 92. Other spacings and/or layouts may, however, be used. For example, the gaps may be non-uniform, with at least one of the gaps differing from at least one other gap. Indeed, a configuration where none of the gaps are the same may be used.

The interior dummy metal 92 overlies or underlies the patch radiator 71 and is configured to be non-radiating, i.e., not to radiate energy at the radiating frequency even though current may be induced in one or more of the interior dummy metal pieces 102 at the radiating frequency. While some energy may leak from any one of the interior dummy metal pieces 102, the interior dummy metal pieces 102 will not resonate at the radiating frequency. The interior dummy metal 92, comprising the interior dummy metal pieces 102, is configured not to radiate at the radiating frequency. Alternatively, interior dummy metal may be configured to couple to the radiating patches but not to radiate because the physical sizes of the dummy metal pieces are much smaller than (generally less than a tenth of wavelength) a wavelength of the radiating frequency.

To help prevent radiation at the radiating frequency(ies), each of the interior dummy metal pieces 102 may be sized and shaped such that a longest linear (i.e., straight) dimension of an edge of the interior dummy metal piece 102 is less than one tenth of the radiating wavelength. Also, each linear edge of the interior dummy metal pieces 102 (e.g., length and width (i.e., longer linear edge length and shorter linear edge length) of a rectangular piece) may be longer than one twentieth of the radiating wavelength.

Not all of the pieces of interior dummy metal need to have the longest linear edge dimension less than one tenth of the radiating wavelength at the radiating frequency of the patch radiator 71 in the antenna 62. The interior dummy metal underlying a center portion of the patch radiator 71 may have linear edge dimension that is larger than one tenth of the radiating wavelength as the electrical current under the center of the patch is very weak and does not couple well to the dummy metal. For example, referring also to FIG. 6, a large interior dummy metal piece 106 overlies or underlies a centerline 99 of a patch radiator 97. The centerline 99 is an imaginary line that extends through a center of the patch radiator 97 through all of the layers of the antenna 62. The large interior dummy metal piece 106 may, for example, extend orthogonally towards any edge of the patch radiator 97 (i.e., in a direction that is orthogonal to an edge of the patch radiator 97 projected into the layer of the dummy metal) one sixth of the radiating wavelength or less and not radiate at the radiating frequency. The large interior dummy metal piece 106 may be co-centered with the patch radiator 97 (i.e., a center of the large interior dummy metal piece 106 may lie along the centerline 99) and have a longest straight edge be no more than one third of the radiating wavelength. The large interior dummy metal piece 106 may be a contiguous sheet (i.e., solid in two dimensions) of metal and positioned under the center portion of the patch radiator 97.

The large interior dummy metal piece 106 will couple to the radiating patch very weakly and not radiate at the radiating frequency.

Figure 6:
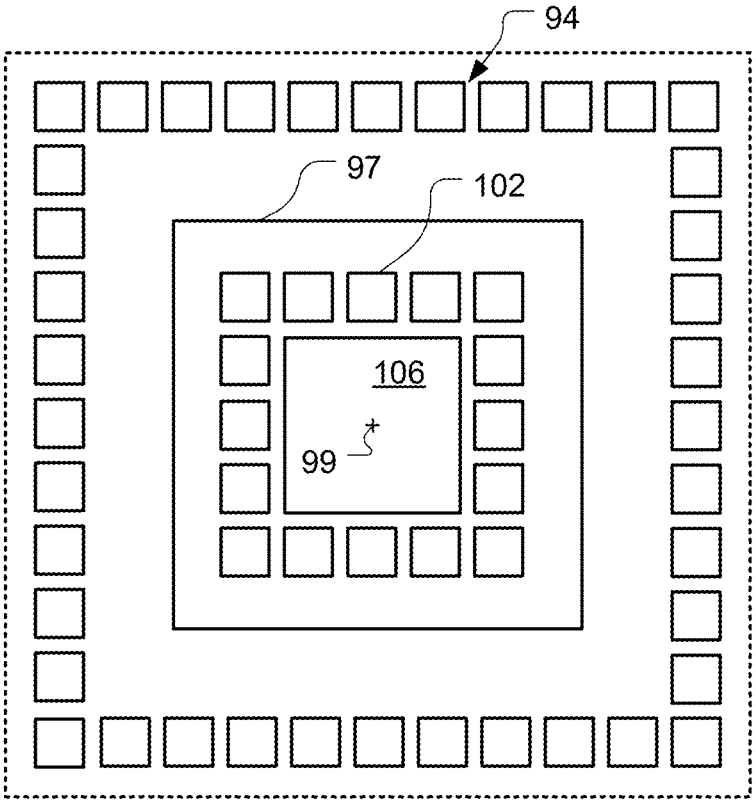
FIGS. 6-7 are top views of an alternative patch radiator portions.
Figure 7:
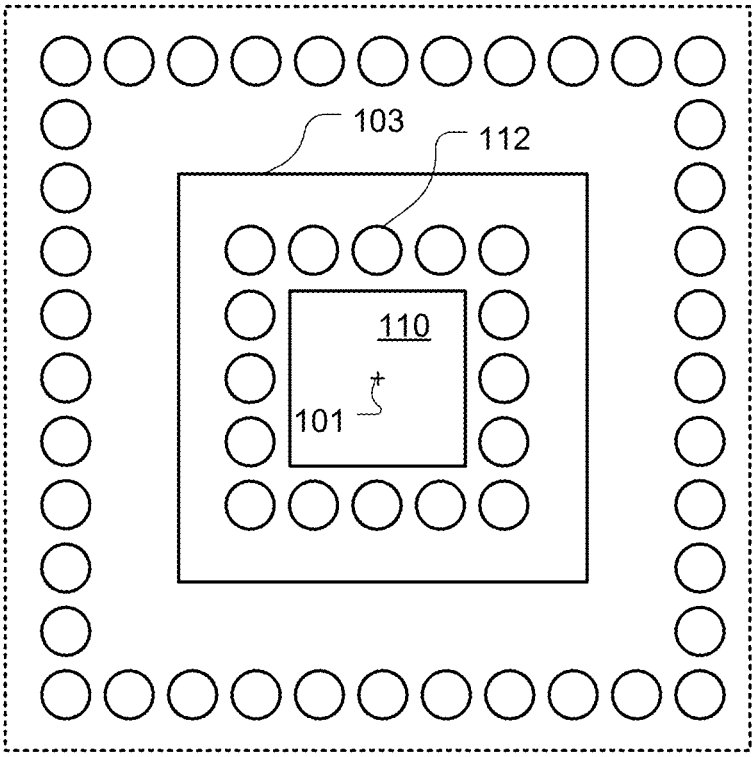

The interior dummy metal pieces 102 are similarly shaped, but may be differently shaped. Here, the interior dummy metal pieces 102 are squares, but other shapes, such as circles (as shown in FIG. 7), rectangles with unequal sides, triangles, ovals, irregular shapes, etc. may be used. Smooth-exterior shapes such as circles or ovals may have a longest linear dimension (e.g., diameter of a circle) that is less than a half of the radiating wavelength, e.g., less than ⅓ (or ⅕ or 1/10) of the radiating wavelength and more than 1/20 of the radiating wavelength. Shapes with straight edges may be configured such that no straight edge is longer than half of the radiating wavelength, e.g., less than ⅓ (or ⅕ or 1/10) of the radiating wavelength and more than 1/20 of the radiating wavelength. While the interior dummy metal pieces 102 shown in FIG. 5 are all the same shape, however, the interior dummy 94 may have different shapes within a single layer of the PCB 56 (e.g., as shown in FIG. 6), and/or different layers of the PCB 56 may have different shapes of the interior dummy metal 94. For example, referring to FIG. 7, a large interior dummy metal piece 110 is a square, while small interior dummy metal pieces 112 (e.g., pieces further than half way from a centerline 101 of a patch radiator 103 orthogonally toward any edge of the patch radiator 103) are circles.

Referring again to FIG. 5, the exterior dummy metal pieces 104 are configured not to radiate at the radiating frequency and may be shaped similarly to the interior dummy metal pieces 102. For example, the exterior dummy metal pieces 104 may have a longest linear edge dimension less than one tenth of the radiating wavelength and longer than one twentieth of the radiating wavelength. As with the interior dummy metal pieces 102, the exterior dummy metal pieces 104 may have other shapes (e.g., see FIG. 7), and may have different shapes within a single layer of the PCB 56. The exterior dummy metal pieces 102 also are configured not to radiate, here a longest linear edge dimension of each of the exterior dummy metal pieces 104 being less than one tenth of the radiating wavelength. As shown, the exterior dummy metal pieces 104 are spaced uniformly from each other and disposed uniformly, with no missing pieces, about the patch radiator 71, but other spacings and/or layouts may be used.

The interior dummy metal 92 and the exterior dummy metal 94 are disposed such that the keep-out zone 96 is absent from (i.e., devoid of) dummy metal. Thus, no dummy metal overlies or underlies the perimeter 98 of the patch radiator, or a region adjacent and exterior to the perimeter 98, or a region adjacent and interior to the perimeter 98. Dummy metal in other layers (i.e., layers other than the layer(s) in which the dummy metal 92, 94 is(are) disposed) of the antenna 62 will also be absent from the keep-out zone 96. The keep-out zone 96 is a ring that is devoid of dummy metal, here with the exterior dummy metal 94 disposed outwardly of the ring. A width 114 of the keep-out zone external to the perimeter 98 may, for example, be one tenth or one twentieth of the radiating wavelength. A width 116 of the keep-out zone internal to the perimeter 98 may, for example, be one tenth, one twentieth, or one fortieth of the radiating wavelength.

Figure 8:
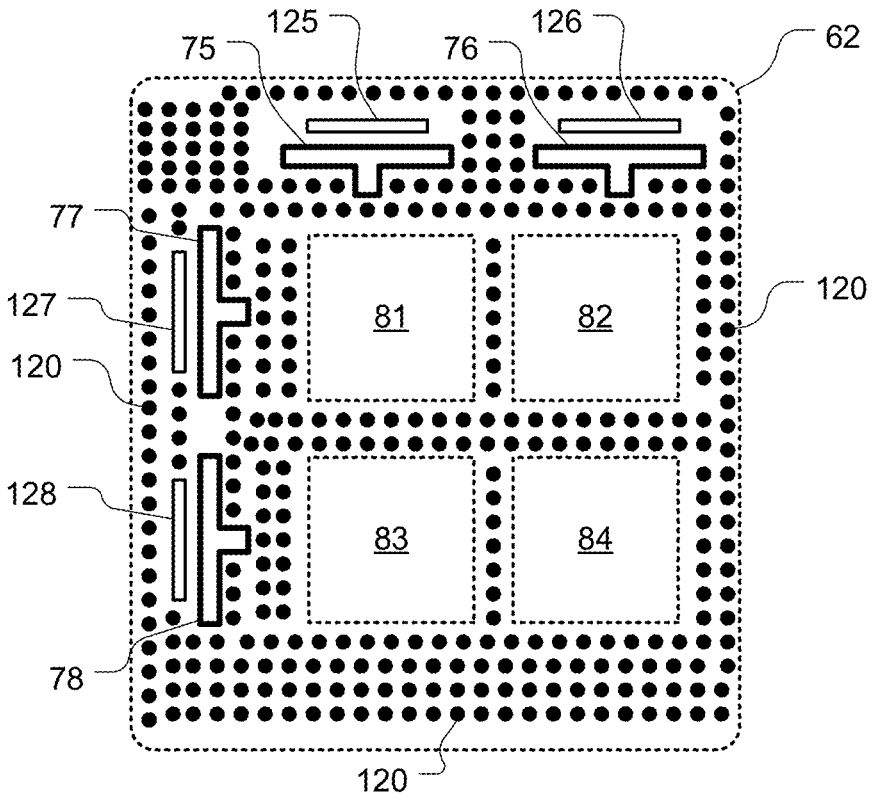
FIG. 8 is a top view of the antenna shown in FIG. 4, showing patch radiator dummy metal and dummy fills.

Referring to FIG. 8, with further reference to FIGS. 3-5, in addition to the patch radiator regions 81-84 and the dipole radiators 75-78, the antenna 62 includes dummy fill pieces 120 and parasitic strips 125, 126, 127, 128. The parasitic strips 125-128 are configured to enhance performance of the dipole radiators 75-78, respectively. The parasitic strips 125-128 are not connected to a feeding network. The parasitic strips 125-128 and the dipole radiators 75-78 are disposed far enough away from the patch radiators 71-74 of the patch radiator regions 81-84 not to have significant current at the radiating frequency induced in each other. The dummy fill pieces 120 are thin metal pieces each disposed in a layer of the antenna 62 and configured not to radiate at the radiating frequency. The dummy fill pieces are shown as circles, but one or more other shapes may be used (e.g., squares, rectangles with different length sides, etc.), including multiple different shapes in the same layer in the antenna 62 and/or different shapes in different layers of the antenna 62. The dummy fill pieces 120 may be disposed over each other in different layers of the antenna 62 forming a column although the dummy fill pieces 120 in successive layers may not be touching each other.

Each layer of the antenna 62 is configured to have enough metal to provide mechanical stability to the layer. For example, at least 40% of an area of each layer of the antenna 62 may be occupied by metal, e.g., from patch radiators 71-74, the dipole radiators 75-78, the parasitic strips 125-128, the dummy metal 92, 94, and/or the dummy fill pieces 120, and/or other metal (e.g., parasitic strips and/or parasitic patches discussed below, etc.) disposed in a layer. As another example, at least 50% (or another percentage) of the area of each layer of the antenna 62 may be occupied by metal. Further, at least 40%, 50%, or another percentage, of each layer of the substrate 70 of the PCB 56 may be occupied by metal.

Figure 9:
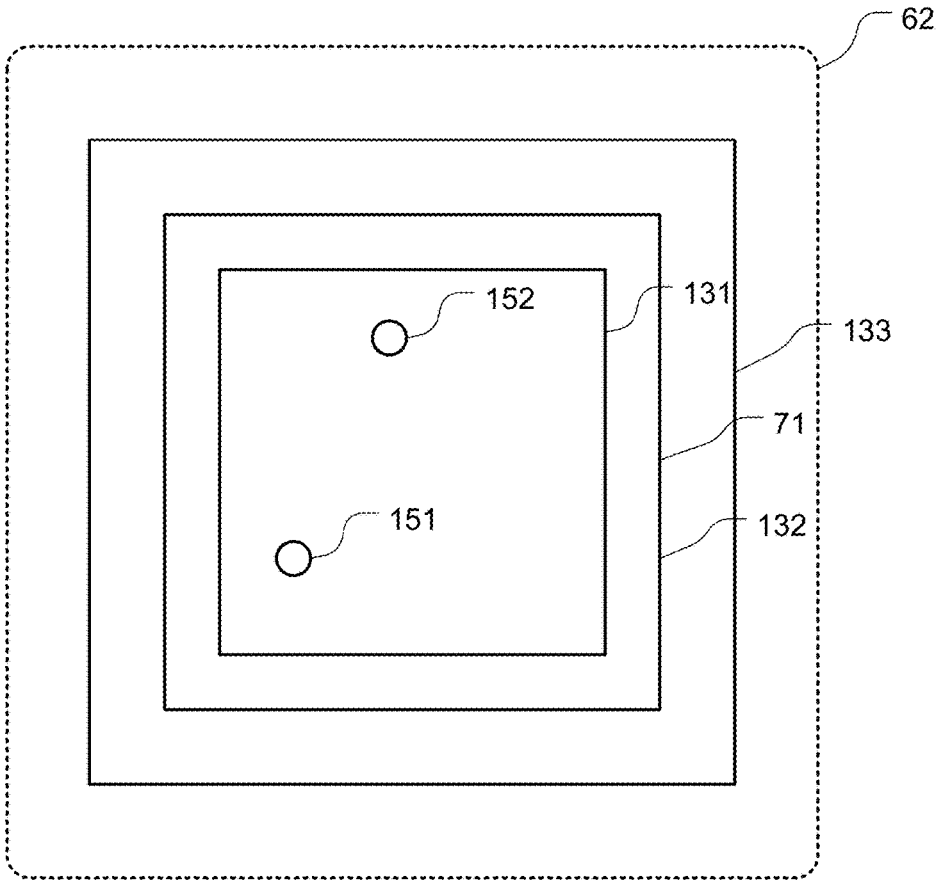
FIG. 9 is a top view of the patch radiator portion shown in FIG. 5, showing a patch radiator and parasitic elements.
Figure 10:
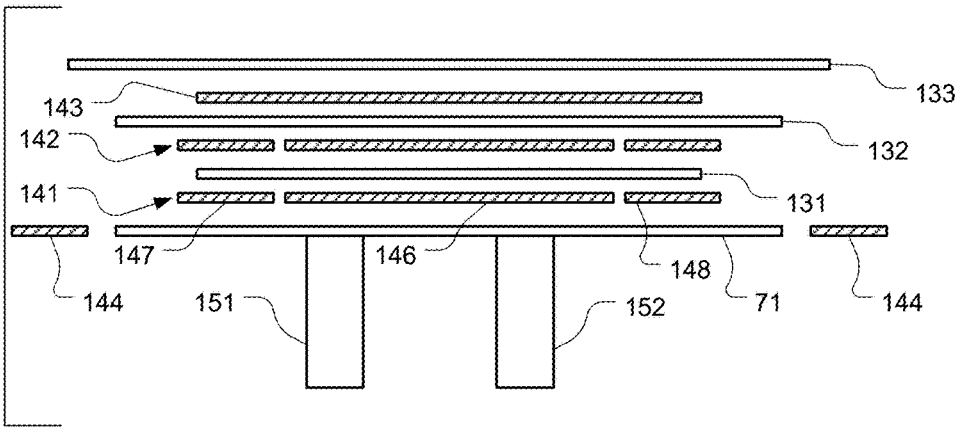
FIG. 10 is a side view of feeds, a patch radiator, dummy metal, and parasitic elements of the patch radiator portion shown in FIG. 5.
Figure 11:
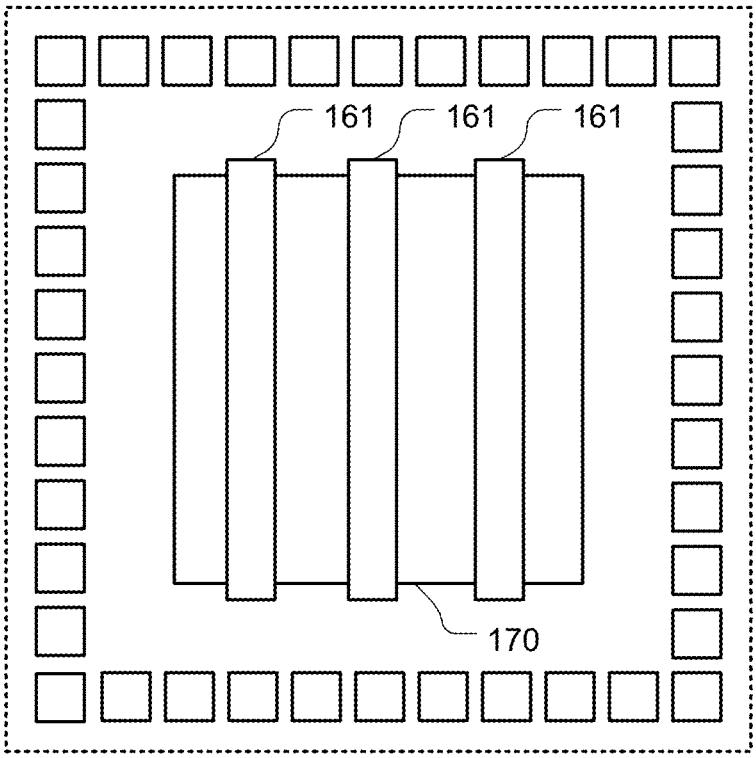
FIG. 11 is a top view of an alternative patch radiator and parasitic element configuration.

Referring to FIGS. 9-10, with further reference to FIGS. 3-5, the antenna 62 includes parasitic patch elements 131, 132, 133, dummy metal 141, 142, 143, 144 (not shown in FIG. 9), and feeds 151, 152. The cross-hatching of the dummy metal 141-144 is to aid in distinguishing layers and is not an indication of being cross-sections of these elements. Any or each of the dummy metal 141-144 may comprise the dummy metal 92, 94. More dummy metal than the dummy metal 141-144 shown may be used, e.g., more dummy metal in one or more of the layers occupied by the dummy metal 141-144, respectively, and/or dummy metal in one or more other layers such as the layers containing the parasitic patch elements 131-133. Further, some of the dummy metal 141-144 shown in FIG. 10 may not be used, e.g., the dummy metal 144, depending upon one or more factors such as electrical performance and/or structural integrity of the antenna 62. The dummy metal 141 includes a large dummy metal piece 146 and small dummy metal pieces 147, 148. The small dummy metal pieces 147, 148 overlap respective edges of the parasitic patch element 131 but not edges of the patch radiator 71. The dummy metal 142 is configured (here shaped and disposed) similarly to the dummy metal 141. The dummy metal 143 is configured differently than the dummy metal 141-142, but may, in other examples, be configured similarly. Dummy metal is not illustrated as being disposed on the same layer as any of the parasitic patch elements 131-133, but dummy metal may be disposed on the same layer as one or more of these elements (e.g., in an area outside a perimeter of one or more of the elements). Further, while pieces of the dummy metal 141, 142 are shown as having different edge lengths within each layer, the dummy metal pieces of any of the layers may be symmetrically shaped and/or uniformly dispersed throughout the layer. In some such embodiments, a longest linear dimension of each piece is less than 1/20 of the radiating wavelength of the patch radiator 71. The feeds 151, 152 are configured and coupled to the patch radiator 71 to deliver energy to be radiated by the patch radiator 71. The feeds 151, 152 are disposed to cause the patch radiator 71 to radiate with two different polarizations, e.g., to provide circularly polarized radiation in combination. The feeds 151, 152 are isolated from, do not connect to, any of the parasitic patch elements 131-133. Currents are induced, from energy from the patch radiator 71, in the parasitic patch elements 131-133 causing the parasitic patch elements 131-133 to contribute radiation at respective radiating frequencies based on lengths of edges of the parasitic patch elements 131-133. In the example shown in FIG. 9, the parasitic patch elements 131-133 are sheets of metal shaped similarly to the patch radiator 71 (i.e., the parasitic patch elements 131-133 are rectangular (here square) patches), and co-centered with and overlying the patch radiator 71, but other shapes and/or placements of parasitic patch elements may be used. For example, as shown in FIG. 11, parasitic strips 161 of metal may be used with a patch radiator 170, with two of the parasitic strips 161 being offset from a center of the patch radiator 170. Further, while the parasitic elements 131-133 have edges parallel or perpendicular to edges of the patch radiator 71 and the parasitic strips 161 have edges parallel or perpendicular to edges of the patch radiator 170, one or more parasitic elements may have one or more edges that are oblique relative to edges of a patch radiator. As another example of alternative parasitic element placement, one or more parasitic elements may underlie the patch radiator 71.

Returning to FIGS. 9-10, the dummy metal 141 is disposed between the parasitic element 131 and the patch radiator 71, the dummy metal 142 is disposed between the parasitic patch element 131 and the parasitic patch element 132, and the dummy metal 143 is disposed between the parasitic patch element 132 and the parasitic patch element 133. For example, the dummy metal 141-143 may be disposed in layers 9, 11, and 13, respectively, of a 14-layer PCB, and the patch radiator 71 and the parasitic patch elements 131-133 may be disposed in layers 8, 10, 12, and 14, respectively, of the 14-layer PCB. Numerical nouns used herein with respect to layers are indicative of locations of the layers in the PCB, e.g., layer 1 is a bottom-most layer, layer 2 is the layer above and adjacent to layer 1, etc. Numerical adjectives used herein (including in the claims) with respect to layers are generic references to layers and do not, by themselves, indicate a specific location in a multi-layer antenna, or a specific relative location of one layer to another layer. For example, a first layer may be in layer 9 of a PCB. As another example, a second layer may be separated from (not adjacent to) a first layer. As another example, a third layer may be adjacent to a first layer, e.g., may be layer 8 or layer 10 of the PCB with the first layer being in layer 9 of the PCB.

The parasitic patch elements 131-133 may be of various sizes relative to the size of the patch radiator 71. Here, the parasitic patch elements 131, 133 have different sizes and areas than the size and area of the patch radiator 71, with the parasitic patch element 131 being smaller in area than the patch radiator 71, the parasitic patch element 132 being similar in area than the patch radiator 71, and the parasitic patch element 133 being larger in area than the patch radiator 71. Thus, each of the parasitic patch elements 131-133 is disposed in a respective layer of the antenna 62 and each of the parasitic patch elements 131-133 is larger in size than a nearest one of the parasitic patch elements 131-133 that is closer to the patch radiator 71.

Parasitic elements may be disposed above and/or below the radiator. In FIG. 10, the parasitic patch elements 131-133 are all disposed above the patch radiator 71, but other example configurations may be used, e.g., with one or more parasitic patch elements also, or alternatively. disposed below the patch radiator 71.

Structures discussed may provide for mm-wave antennas with good electrical performance and good structural integrity. A multi-layer PCB may be used to provide multiple radiators that can radiate over a mm-wave frequency band in edge-fire and perpendicular directions relative to the PCB, and thus, for example, relative to a plane of a mobile device such as a smart phone. Such configurations may be useful to provide an antenna system for use in fifth-generation (5G) mobile communications, e.g., over frequencies near a 28 GHz band. Metal added to layers of the multi-layer PCB can help provide structural integrity to the PCB and may also improve electrical performance of the antenna system, e.g., widening a bandwidth of patch radiators near the added metal. For example, a bandwidth of a patch radiator may be expanded from about 26.5 GHz to about 29.5 GHz with return loss greater than 10 dB to a bandwidth from about 26 GHz to about 31 GHz with return loss greater than 10 dB, although different dummy metal configurations may yield different bandwidths. The use of dummy metal may help improve bandwidths, and/or other antenna performance characteristics (e.g., gain, directionality), for similar and/or other bandwidths, e.g., a 38 GHz bandwidth.

OTHER CONSIDERATIONS

Also, as used herein, "or" as used in a list of items prefaced by "at least one of" or prefaced by "one or more of" indicates a disjunctive list such that, for example, a list of "at least one of A, B, or C," or a list of "one or more of A, B, or C" means A or B or C or AB or AC or BC or ABC (i.e., A and B and C), or combinations with more than one feature (e.g., AA, AAB, ABBC, etc.).

Further, an indication that information is sent or transmitted, or a statement of sending or transmitting information, "to" an entity does not require completion of the communication. Such indications or statements include situations where the information is conveyed from a sending entity but does not reach an intended recipient of the information. The intended recipient, even if not actually receiving the information, may still be referred to as a receiving entity, e.g., a receiving execution environment. Further, an entity that is configured to send or transmit information "to" an intended recipient is not required to be configured to complete the delivery of the information to the intended recipient. For example, the entity may provide the information, with an indication of the intended recipient, to another entity that is capable of forwarding the information along with an indication of the intended recipient.

Substantial variations may be made in accordance with specific requirements. For example, customized hardware might also be used, and/or particular elements might be implemented in hardware, software (including portable software, such as applets, etc.) executed by a processor, or both. Further, connection to other computing devices such as network input/output devices may be employed.

The systems and devices discussed above are examples. Various configurations may omit, substitute, or add various procedures or components as appropriate. For instance, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of operations may be undertaken before, during, or after the above elements are considered. Accordingly, the above description does not bound the scope of the claims.

Further, more than one invention may be disclosed.

The invention claimed is:

1. A multi-layer laminate antenna comprising:

a feed line configured to convey electricity;

a radiator coupled to the feed line, comprising metal disposed in a first layer of the antenna, and having an edge of a length to radiate energy at a radiating frequency; and dummy metal disposed in a second layer of the antenna that is different from the first layer of the antenna, the dummy metal configured to radiate an insignificant amount of energy, if any, at the radiating frequency;

wherein a first portion of the dummy metal is at least partially disposed outside an overlapped area of the second layer that is overlapped by the radiator and is configured such that any linear edge of the first portion of the dummy metal disposed outside the overlapped area is less than half of a radiating wavelength corresponding to the radiating frequency, and wherein the dummy metal is absent from a region of the second layer that overlaps a perimeter of the radiator, the dummy metal being displaced from a first orthogonal projection of a perimeter of the radiator onto the second layer.

2. The antenna of claim 1, wherein the first portion of the dummy metal comprises a plurality of similarly-shaped pieces each with a longest linear edge dimension being shorter than one-tenth of the radiating wavelength.

3. The antenna of claim 2, wherein the plurality of similarly-shaped pieces are rectangular.

4. The antenna of claim 3, wherein the plurality of similarly-shaped pieces are electrically separated from each other.

5. The antenna of claim 1, wherein the first portion of the dummy metal comprises a plurality of pieces, wherein at least one of the plurality of pieces is circularly shaped, or at least one of the plurality of pieces is triangularly shaped, or at least one of the plurality of pieces is irregularly shaped.

6. The antenna of claim 1, wherein the radiator comprises at least one patch radiator, or at least one dipole radiator, or a combination of at least one patch radiator and at least one dipole radiator.

7. The antenna of claim 1, wherein the radiator is a rectangular patch radiator, wherein a virtual centerline extends through a center of the patch radiator perpendicularly to the first layer and the second layer, wherein the first portion of the dummy metal comprises all of the dummy metal disposed in the second layer more than one-eighth of the radiating wavelength, corresponding to the radiating frequency, away from the centerline orthogonally toward any edge of the rectangular patch radiator projected into the second layer, and wherein the first portion of the dummy metal is configured such that any linear edge of the first portion of the dummy metal is less than half of the radiating wavelength.

8. The antenna of claim 7, wherein the rectangular patch radiator is square, and wherein a second portion of the dummy metal, separate from the first portion of the dummy metal and in the second layer, comprises a contiguous sheet of metal, overlaps the patch radiator, is co-centered with the patch radiator, and has a longest straight edge length no more than one-third of the radiating wavelength corresponding to the radiating frequency.

9. The antenna of claim 7, wherein at least some of the first portion of the dummy metal overlaps with the rectangular patch radiator.

10. The antenna of claim 1, wherein the dummy metal is first dummy metal, the antenna further comprising second dummy metal disposed in a third layer of the antenna that is separate from the first layer and the second layer, the second dummy metal being displaced from a second orthogonal projection of the perimeter of the radiator onto the third layer.

11. The antenna of claim 1, wherein a second portion of the dummy metal overlaps the patch radiator.

12. The antenna of claim 11, wherein the first portion of the dummy metal, the second portion of the dummy metal, and the patch radiator are co-centered such that the second layer comprises the second portion of the dummy metal surrounded by a ring of the second layer that is devoid of metal and at least some of the first portion of the dummy metal disposed outwardly of the ring.

13. The antenna of claim 1, further comprising a parasitic element disposed in a fourth layer of the antenna, the parasitic element comprising a sheet of metal overlying the patch radiator and being electrically isolated from the feed line, the second layer of the antenna being disposed between the first layer of the antenna and the fourth layer of the antenna and adjacent to the fourth layer of the antenna.

14. The antenna of claim 13, wherein an area of the parasitic element is different in size than an area of the patch radiator.

15. The antenna of claim 14, wherein the parasitic element is one of a plurality of parasitic elements each disposed in a respective layer of the antenna, each of the plurality of parasitic elements being larger in size than a nearest one of the plurality of parasitic elements that is closer to the patch radiator.

16. The antenna of claim 1, wherein the dummy metal is disposed over an area that is at least 40% of an area of the second layer.

17. The antenna of claim 1, wherein the dummy metal is first dummy metal, the antenna further comprising second dummy metal disposed in the first layer of the antenna.

18. The antenna of claim 1, wherein the dummy metal is displaced at least one twentieth of the radiating wavelength outwardly from the first orthogonal projection of the perimeter and is displaced at least one fortieth of the radiating wavelength inwardly from the first orthogonal projection of the perimeter.

19. A multi-layer laminate antenna comprising:

radiating means for radiating energy at a radiating frequency, the radiating means being disposed in a first layer of the antenna and comprising a contiguous piece of metal configured to radiate at the radiating frequency; and first means for stiffening disposed in a second layer of the antenna that is different from the first layer of the antenna, the first means for stiffening comprising metal that is electrically separate from any metal in any other layer of the multi-layer laminate antenna, and that has a longest linear dimension less than one-third of a radiating wavelength in the antenna at the radiating frequency, wherein the first means for stiffening are absent from a region of the second layer that overlaps a perimeter of the contiguous piece of metal.

20. The antenna of claim 19, wherein the first means for stiffening comprise a plurality of rectangular metal pieces each with a longest linear edge length no more than one-fifth of the radiating wavelength and each of the plurality of rectangular metal pieces with a shorter linear edge length at least one-tenth of the radiating wavelength.

21. The antenna of claim 20, wherein the contiguous piece of metal is a rectangular patch radiator, wherein a virtual centerline extends through a center of the radiating means perpendicularly to the first layer and the second layer, and wherein the plurality of rectangular metal pieces comprise all of the first means for stiffening disposed in the second layer more than one-fourth of the length of each edge of the radiating means away from the centerline orthogonally toward any edge of the contiguous piece of metal projected into the second layer.

22. The antenna of claim 20, wherein the radiating means comprises a contiguous piece of metal configured to radiate at the radiating frequency and wherein some of the plurality of rectangular metal pieces overlap with the contiguous piece of metal.

23. The antenna of claim 19, further comprising second means for stiffening disposed in a third layer of the antenna that is separate from the first layer and the second layer, the second means for stiffening being absent from a region of the third layer that overlaps the perimeter of the contiguous piece of metal.

24. The antenna of claim 19, wherein a first portion of the first means for stiffening overlaps the contiguous piece of metal and a second portion of the first means for stiffening is disposed outwardly of the perimeter of the contiguous piece of metal projected, orthogonally to the first layer and the second layer, onto the second layer.

25. The antenna of claim 19, wherein the first means for stiffening is further for increasing a bandwidth of the radiating means while maintaining a gain of the radiating means.

26. A mobile device comprising:

a display;

a processor communicatively coupled to the display;

a transceiver communicatively coupled to the processor; and an antenna communicatively coupled to the transceiver and comprising:

a feed line configured to convey electricity;

a radiator coupled to the feed line and comprising a solid metal piece disposed in a first layer of the antenna and having an edge length configured to radiate energy at a radiating frequency; and dummy metal disposed in a second layer of the antenna that is different from the first layer of the antenna, the dummy metal comprising a plurality of rectangular pieces of metal each with a longest linear edge length less than one-tenth of a radiating wavelength corresponding to the radiating frequency, the dummy metal being displaced from an orthogonal projection of a perimeter of the radiator onto the second layer.

27. The device of claim 26, wherein the antenna further comprises:

a ground plane;

a parasitic element disposed in a third layer of the antenna, with the first layer overlying the ground plane, the second layer overlying the first layer, and the third layer overlying the second layer.

28. The device of claim 27, wherein the parasitic element is a first dummy parasitic element, the dummy metal is first dummy metal, and the antenna further comprises:

second dummy metal disposed in a fourth layer of the antenna that is different from the first, second, and third layers of the antenna, the second dummy metal comprising a plurality of rectangular pieces of metal each with a longer linear edge length less than one-tenth of the radiating wavelength, the second dummy metal being absent from a region of the fourth layer overlapping a perimeter of the radiator; and a second dummy parasitic element disposed in a fifth layer of the antenna;

wherein the fourth layer overlies the third layer and the fifth layer overlies the fourth layer.

29. The device of claim 26, wherein the dummy metal is disposed over an area that is at least 40% of an area of the second layer.

* * * * *